US006398174B1

(12) United States Patent
Emalfarb

(10) Patent No.: US 6,398,174 B1
(45) Date of Patent: Jun. 4, 2002

(54) RECEPTACLE WITH ADJUSTABLE HANGING BRACKET ASSEMBLY

(76) Inventor: Bradley S. Emalfarb, 763 Bunker Ct., Riverwoods, IL (US) 60015

( * ) Notice: Subject to any disclaimer, the term of this patent is extended or adjusted under 35 U.S.C. 154(b) by 0 days.

(21) Appl. No.: 09/575,747

(22) Filed: May 22, 2000

(51) Int. Cl.[7] ..... A47B 96/06

(52) U.S. Cl. ..... 248/214; 248/231.61; 248/295.11

(58) Field of Search ..... 248/214, 231.21, 248/231.71, 316.1, 228.3, 228.6, 302, 303, 304, 295.11, 231.61; 47/67

(56) References Cited

U.S. PATENT DOCUMENTS

| | | | | | |
|---|---|---|---|---|---|
| 1,532,688 | A | * | 4/1925 | Feuerstein | 248/229.12 |
| 1,772,176 | A | * | 8/1930 | Benjamin | 131/235.1 |
| 3,319,916 | A | * | 5/1967 | Malicoat | 248/210 |
| 3,664,626 | A | * | 5/1972 | Sneller | 248/224.7 |
| 4,138,019 | A | * | 2/1979 | Smith | 211/87 |
| 4,301,767 | A | * | 11/1981 | Willinger et al. | 119/5 |
| 4,727,890 | A | * | 3/1988 | Vincent | 131/329 |
| 5,173,181 | A | * | 12/1992 | McFarland | 210/169 |
| 5,390,443 | A | | 2/1995 | Emalfarb et al. | 47/67 |
| 5,711,502 | A | | 1/1998 | Emalfarb | 248/302 |
| 5,996,506 | A | * | 12/1999 | Woytovich | 108/42 |

* cited by examiner

*Primary Examiner*—Leslie A. Braun
*Assistant Examiner*—Gwendolyn Baxter
(74) *Attorney, Agent, or Firm*—Wood, Phillips, Katz, Clark and Mortimer

(57) ABSTRACT

An article hanger with a frame defining a receptacle for an article and a bracket assembly on the frame through which the article hanger is maintainable in a hanging position on an upwardly facing surface on a support. The bracket assembly includes a first bracket element on the frame and a second bracket element that is joinable to the first bracket element so that at least one of the first and second bracket elements defines a downwardly facing surface that is abuttable to an upwardly facing surface on the support, with the article hanger in the hanging position. The second bracket element has a depending portion which defines an edge which faces the receptacle and is spaced from the receptacle a distance. There is an opening in at least one of the first and second bracket elements and a fastener which is extendable through the opening to maintain the first and second bracket elements in joined relationship. The first and second bracket elements are configured to allow the distance between the edge on the depending portion and the receptacle to be varied.

19 Claims, 4 Drawing Sheets

Fig. 1
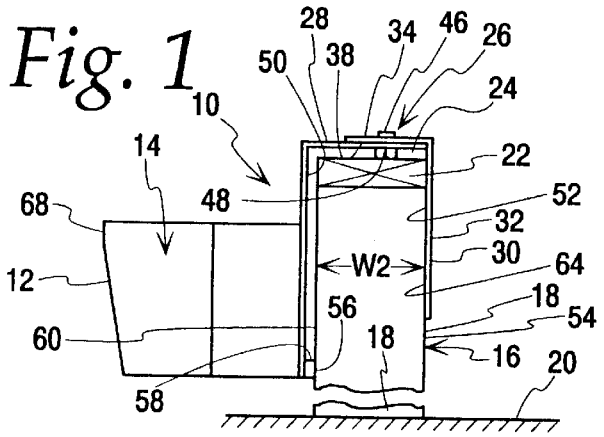
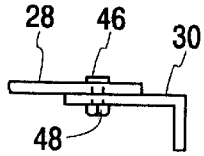
Fig. 10
Fig. 2
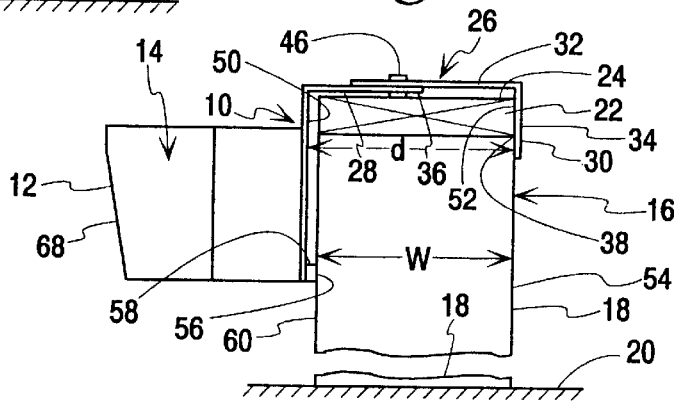
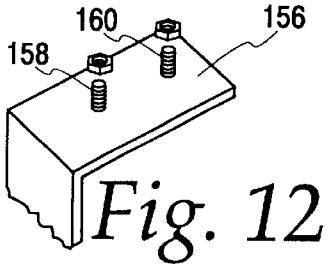
Fig. 12
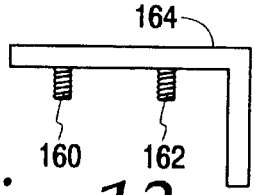
Fig. 13
Fig. 11
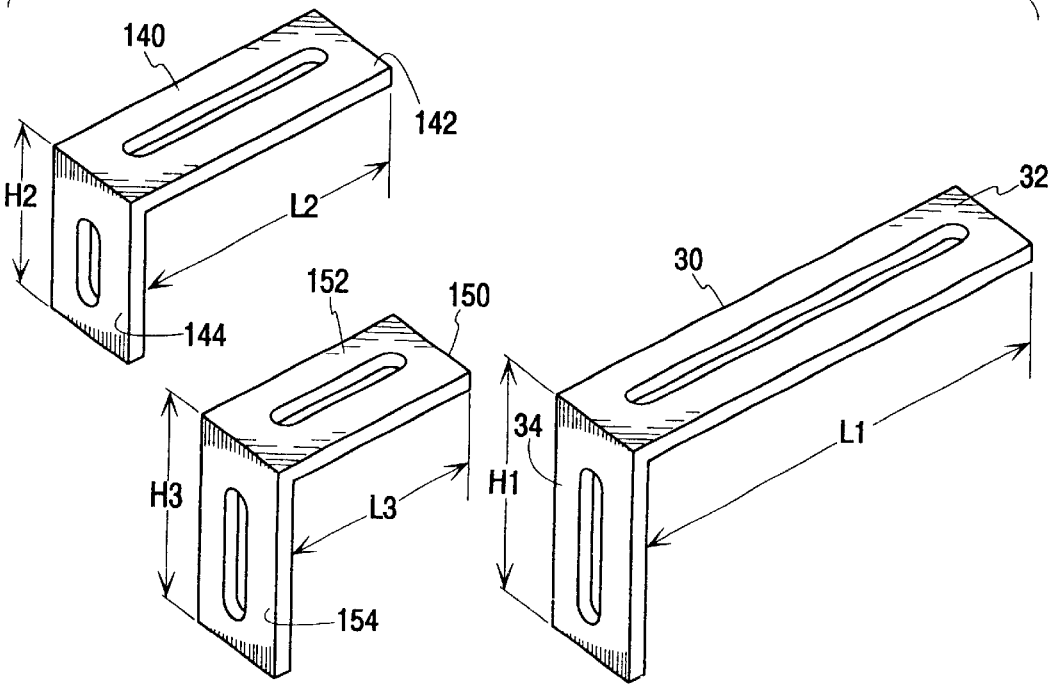

RECEPTACLE WITH ADJUSTABLE HANGING BRACKET ASSEMBLY

BACKGROUND OF THE INVENTION

1. Field of the Invention

This invention relates to receptacles of the type used to hold plants, and the like, and, more particularly, to a receptacle that is supportable in an elevated position by a bracket assembly.

2. Background Art

Many different types of receptacle are currently being offered for supporting objects, such as plants, in an elevated position upon an upright structure. It is common to support such receptacles from deck rails, and the like, having an upwardly facing support surface that bears on a bracket assembly projecting from the receptacle.

One exemplary bracket assembly is shown in U.S. Pat. No. 5,390,443. In this patent, a receptacle is shown with a fixed wire bracket assembly which defines an inverted U shape to straddle an upright support. This design has achieved considerable success commercially.

However, one drawback with this design is that it is dimensioned to be optimally engaged by a particular width of support surface. For example, the bracket assembly may be designed for a nominal four inch width lumber commonly used to define a deck railing. The bracket assembly would have a different design for a wider piece of lumber. As a result, purveyors of this type of receptacle would be required to design, have manufactured, and make available, multiple different designs. The need for multiple designs may increase manufacturing costs. Inventory control requires that the purveyor attempt to anticipate the demand for particular designs. Multiple designs would be inventoried and displayed, often in quantities inconsistent with their particular demand.

To obviate this problem, the inventor herein designed an adjustable bracket system, as disclosed in U.S. Pat. No. 5.711,502. Through the various bracket assemblies shown in U.S. Pat. No. 5,711,502, the effective bracket width can be varied. Accordingly, a universal "kit" can be sold to accommodate different widths of hanging support surfaces.

SUMMARY OF THE INVENTION

In one form, the invention is directed to an article hanger with a frame defining a receptacle for an article and a bracket assembly on the frame through which the article hanger is maintainable in a hanging position on an upwardly facing surface on a support. The bracket assembly includes a first bracket element on the frame and a second bracket element that is joinable to the first bracket element so that at least one of the first and second bracket elements defines a downwardly facing surface that is abuttable to an upwardly facing surface on the support, with the article hanger in the hanging position. The second bracket element has a depending portion which defines an edge which faces the receptacle and is spaced from the receptacle a distance. There is an opening in at least one of the first and second bracket elements and a fastener which is extendable through the opening to maintain the first and second bracket elements in joined relationship. The first and second bracket elements are configured to allow the distance between the edge on the depending portion and the receptacle to be varied.

The first bracket element may be fixedly attached to the frame.

The first bracket element may project in cantilever fashion from the frame.

In one form, the opening in at least one of the first and second bracket elements includes a first opening in the first bracket element and a second opening in the second bracket element. The first and second openings are registrable to allow the fastener to extend through each of the first and second openings with the first and second bracket elements in joined relationship.

The first and second openings are registrable with the edge on the depending portion spaced from the receptacle first and second distances.

In one form, at least one of the first and second openings is an elongate slot.

The opening in at least one of the first and second bracket elements may include a third opening in one of the first and second bracket elements that is registrable with one of the first and second openings to allow the fastener to be extended through the third opening and the one of the first and second openings.

In one form, the second bracket element has an L shape with first and second transverse legs each having a length. The lengths of the first and second legs are different. The first and second legs are selectively joinable to the first bracket element so that a) with the first leg joined to the first bracket element the second leg defines the edge which faces the receptacle and is spaced from the receptacle a first distance and b) with the second leg joined to the first bracket element the first leg defines the edge which faces the receptacle and is spaced from the receptacle a second distance that is different than the first distance.

The fastener may be separate from the first and second bracket elements or fixedly attached to one of the first and second bracket elements.

In one form, one of the first and second bracket elements has first and second transverse surfaces thereon separate from the fastener that bear against the other of the first and second bracket elements to allow guided movement of the first and second bracket elements, each against the other.

In one form, one of the first and second bracket elements has a first surface and second and third facing surfaces and the other of the first and second bracket elements is guidable simultaneously against the first, second, and third surfaces between a) a first relative position wherein the edge on the depending portion of the second bracket element is spaced from the receptacle a first distance and b) a second relative position wherein the edge on the depending portion of the second bracket element is spaced from the receptacle a second distance.

In one form, there is a fourth surface on the one of the first and second bracket elements that faces the first surface and, in conjunction with the first surface, captively maintains the other of the first and second bracket element.

The invention is also directed to the combination of an article hanger having a frame defining a receptacle for an article, and a bracket assembly on the frame through which the article hanger is maintainable in a hanging position on an upwardly facing surface on a support. The bracket assembly includes a first bracket element on the frame and second and third bracket elements. The second bracket element is joinable to the first bracket element so that at least one of the first and second bracket elements defines a downwardly facing surface that is abuttable to an upwardly facing surface on a support with the article hanger in a hanging position. The second bracket element has a depending portion which defines an edge which faces the receptacle and is spaced from the receptacle a first distance. There is an opening in at least one of the first and second bracket elements. The third bracket element is joinable to the first bracket element in place of the second bracket element so that at least one of the first and third bracket elements defines a downwardly facing surface that is abuttable to an upwardly facing surface on a support with the article hanger in the hanging position. The third bracket element has a depending portion which defines an edge which faces the receptacle and is spaced from the receptacle a second distance. There is an opening in at least one of the first and third bracket elements. A fastener is extendable through a) the opening in at least one of the first and second bracket elements or b) the opening in at least one of the first and third bracket elements to maintain either the first and second bracket elements or the first and third bracket elements in joined relationship.

In one form, the first distance is different than the second distance.

In one form, the first bracket element is L-shaped with first and second transverse legs.

In one form, the opening in at least one of the first and second bracket elements is a first opening in the first bracket element, a second opening in the first leg of the first bracket element, and a third opening in the second leg of the first bracket element.

At least one of the first, second, and third openings may be an elongate slot.

The first bracket element may be fixedly attached to the frame.

The first bracket element may project in cantilever fashion from the frame.

BRIEF DESCRIPTION OF THE DRAWINGS

FIG. 1 is a side elevation view of an article hanger, according to the present invention, consisting of a frame and a bracket assembly, with the bracket assembly including first and second bracket elements that are in a first relative position to maintain the article hanger in a hanging position on an upright support;

FIG. 2 is a view as in FIG. 1 with the bracket elements in a second relative position to maintain the article hanger in the hanging position on an upright support having a width that is different than the width of the upright support in FIG.

FIG. 10 is an enlarged, fragmentary, side elevation view of the bracket elements in FIGS. 1 and 2 in a different overlying/underlying relationship;

FIG. 11 is a perspective view of three different bracket elements usable as a kit and which can be selectively attached to a bracket element on a frame;

FIG. 12 is a fragmentary, perspective view of a modified form of bracket element on a bracket assembly, according to the present invention, which bracket element is attached to a frame;

FIG. 13 is a side elevation view of a bracket element on a bracket assembly, according to the present invention, corresponding to the bracket elements attached to a bracket element on a frame;

DETAILED DESCRIPTION OF THE DRAWINGS

Figure 3:
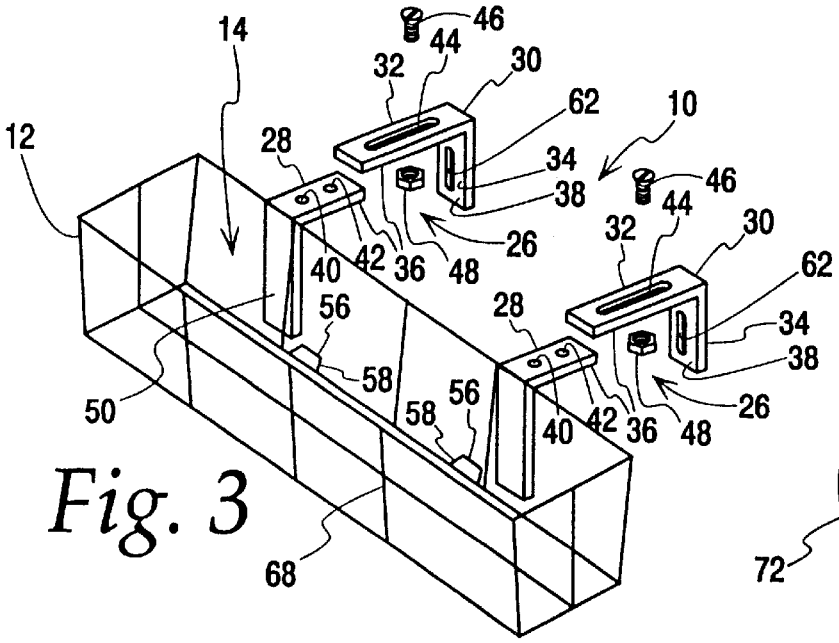
FIG. 3 is an exploded, perspective view of the article hanger in FIGS. 1 and 2 with the bracket elements relatively positioned as in FIG. 2.

In FIGS. 1, 2 and 3, one form of article hanger, according to the present invention, is shown at 10. The article hanger 10 consists of a frame 12, made in this case from formed wire, which defines an upwardly opening receptacle 14, as for a planter, for foliage, or the like, or any other type of product.

The article hanger 10 is designed to be placed in a hanging position, as shown in FIGS. 1 and 2, from an upright support 16. The upright support 16 consists of a member 18, extending vertically from a support surface 20, and having at its upper end a horizontally extending member 22 with an upwardly facing surface 24.

The article hanger 10 is maintained in the hanging position on the upright support 16 by separate, spaced, bracket assemblies 26. The bracket assemblies 26 have the same construction, with each consisting of a first bracket element 28 fixed to and projecting in cantilever fashion from the frame 12, and a second, L-shaped bracket element 30. The bracket element 30 has a long leg 32 and a short leg 34, which make substantially a right angle with respect to each other.

The second bracket element 30 can be joined to the first bracket element 28 in one of two different manners. As shown in FIGS. 2 and 3, the long leg 32 can be joined to the first bracket element 28 so that the long leg 32 and first bracket element 28 cooperatively define a downwardly facing surface 36 to be abutted to the upwardly facing surface 24 on the horizontally extending member 22. With this arrangement, the short leg 34 depends on the bracket assembly 26 so that an edge 38 on the short leg 34 faces, and is spaced from, the receptacle 14, by a distance d.

In the embodiment shown, the first bracket element 28 has spaced first and second openings 40, 42 therethrough which are registrable with an opening 44 through the bracket leg 32. The opening 44 is in the shape of an elongate slot with a lengthwise extent aligned with the length of the leg 32.

Fasteners, which may take any number of different forms, are shown preferably in the form of a bolt 46 and cooperating nut 48 used to maintain the first and second bracket elements 28, 30 in a desired relative position, as dictated by the desired distance d. More particularly, the distance d is selected to accommodate the width of the upright support 16.

In the embodiment shown in FIGS. 1–3, an upright leg 50 on the first bracket element 28, and the back wall of the frame 12 define, in conjunction with the surface 36 and edge 38, an inverted U-shaped receptacle 52 which straddles the upper portion of the support 16 to maintain the article hanger 10 in the hanging position of FIGS. 1 and 2. With the article hanger 10 in the hanging position, the edge 38 bears on the rear wall 54 of the upright support 16, the downwardly facing surface 36 bears on the upwardly facing surface 24 of the upright support 16, and a rearwardly facing edge 56 of a bumper element 58 abuts to a forwardly facing surface 60 of the support 16. It is not actually necessary that the bracket assembly 26 cooperate in the manner shown. For example, the article hanger 10 can be maintained in the hanging position primarily by the cooperation between the rear edge 38 and bumper edge 56 with the rearwardly facing surface 54 and the forwardly facing surface 60 on the support 16.

By inserting the bolt 46 through the slot opening 44 and into one of the first and second openings 40, 42, the second bracket element 30 may be moved relative to the first bracket element 28 an amount determined by the length of the slot opening 44. Once the desired dimension d is realized, the bracket elements 28, 30 can be fixed together by tightening the nut 48 and bolt 46 on each bracket assembly 26.

The cooperative length of the first bracket element 28 and the bracket leg 32 is selected to accommodate an upright support 16 having a first width W. For example, the width W may be a conventional board width, such as a nominal 6 inch board dimension, which is actually 5½ inches.

The second bracket element 30 may be resituated so that the short leg 34 overlies the first bracket element 28. An opening 62, in the form of a slot, is registrable with one or both of the openings 40, 42, to allow the bolt 46 to be passed therethrough and secured. The same adjustable connection can be selected and fixed by tightening the bolt 46 and nut 48. This relationship is shown in FIG. 1. The cooperative length of the first bracket element 28 and short leg 34 is selected to accommodate a narrower width for the upright support 16. In this case, the width W2 may be that for a conventional board, such as a nominal 4 inch width board, which actually has a 3½ inch width. With this configuration, the long leg 32 defines the forwardly facing edge 64 corresponding to the edge 38 in the arrangement shown in FIGS. 2 and 3.

The user has the ability to effect a gross selection of the distance d by connecting the short leg 34 or long leg 32 to the first bracket element 28. Thereafter, adjustment for the distance d can be made depending upon which opening 40, 42 is selected and the width of the particular opening/slot 44, 62.

The precise construction and shape of the frame 12 can vary considerably from that shown. In FIGS. 1–3, the frame 12 has an overall rectangular shape as viewed in plan, and is made from joined wire elements 68 with edges that cooperatively produce an upwardly opening cup shape for the receptacle 14. The bumper elements 58, which have a general configuration as shown in U.S. Pat. No. 5,390,443, incorporated herein by reference, are optional.

Figure 4:
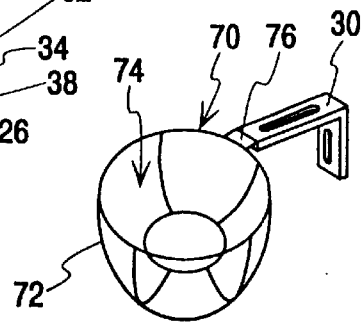
FIG. 4 is a perspective view for another form of article hanger, according to the present invention.

Another suitable shape for the frame 12 is shown in FIG. 4. In FIG. 4, an article hanger is shown at 70 with a wire frame 72 defining a receptacle 74 that is circular in plan view. The frame 72 has a first bracket element 76, corresponding to the first bracket element 28, and cooperates with the second bracket element 30 in the same manner as the second bracket element 30 cooperates with the first bracket element 28.

Figure 5:
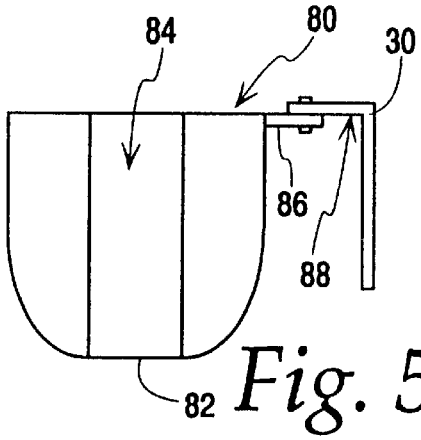
FIG. 5 is a side elevation view of another form of article hanger, according to the present invention.

In FIG. 5, a further modified form of article hanger, according to the present invention, is shown at 80. The article hanger 80 has a frame 82 defining a receptacle 84 with a cantilevered first bracket element 86 designed to cooperate with the second bracket element 30 in the same manner as the second bracket element 30 cooperates with the first bracket elements 28, 76. In this case the first bracket element 86 does not have a vertical leg corresponding to the leg 50 of the prior embodiment. A U-shaped receptacle 88 is defined cooperatively by the frame 82, first bracket element 86, and second bracket element 30.

Figure 6:
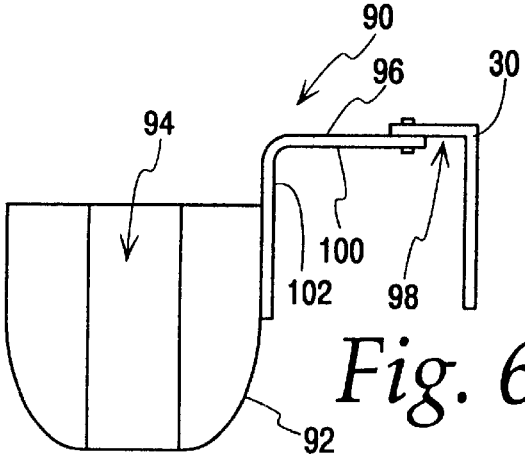
FIG. 6 is a side elevation view of a further form of article hanger, according to the present invention.

In FIG. 6, a further modified form of article hanger is shown at 90. The article hanger 90 consists of a frame 92 bounding a receptacle 94. A first bracket element 96 projects in cantilever fashion from the frame 92 and cooperates with the second bracket element 30 in the manner previously described. In this case, the first bracket element 96 projects upwardly horizontally away from the frame 92. The U-shaped receptacle 98, corresponding to the U-shaped receptacle 52, is defined cooperatively by the bracket 30, a horizontal leg 100 on the first bracket element 96, a vertical leg 102 on the first bracket element 96, and the frame 92.

Figure 7:
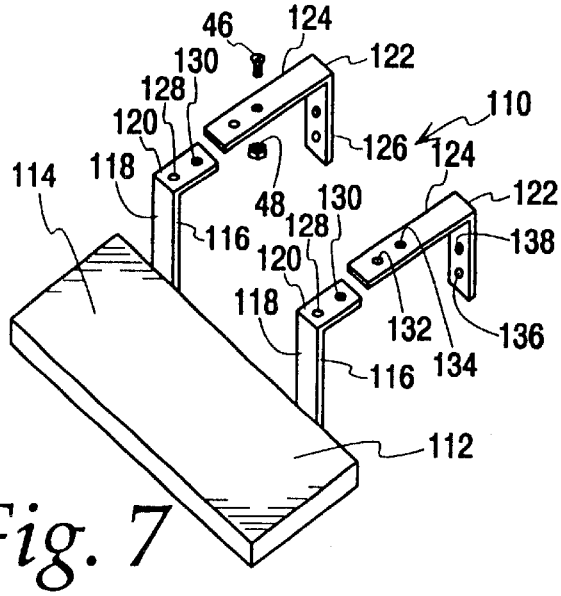
FIG. 7 is an exploded, perspective view of a still further modified form of article hanger, according to the present invention.
Figure 9:
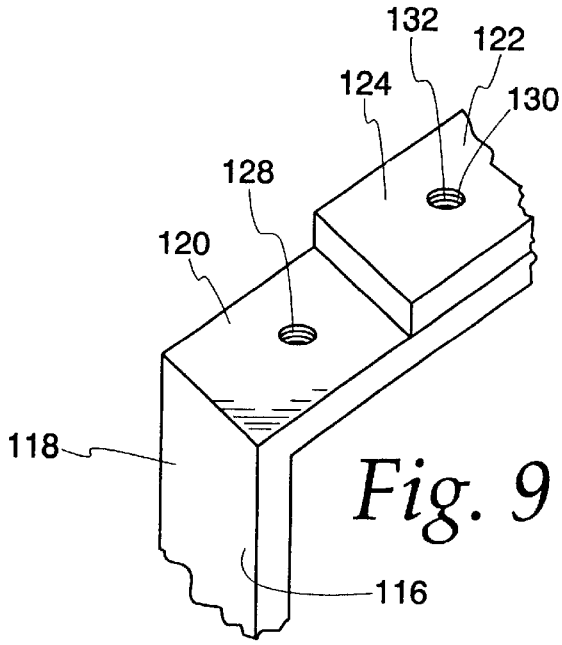
FIG. 9 is an enlarged fragmentary, perspective view of the bracket elements of FIGS. 7 and 8 in another relative position.
Figure 8:
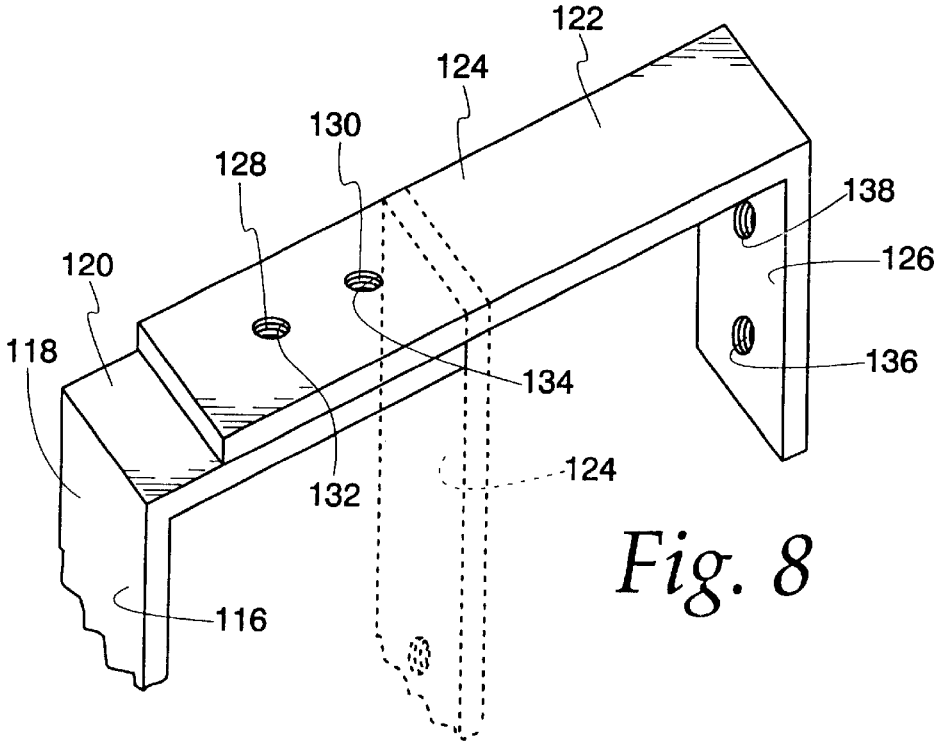
FIG. 8 is an enlarged, fragmentary, perspective view of bracket elements on the article hanger of FIG. 7, with the bracket elements shown in two different positions.

In FIGS. 7–9, a further modified form of article hanger, according to the present invention, is shown at 110. The article hanger 110 consists of a frame element 112 defining a flat, horizontal surface/receptacle 114. A first bracket element 116 has an upright leg 118 projecting from the frame element 112 and a horizontal leg 120 which cooperates with a second bracket element 122. The second bracket element 122 has a long leg 124 and a short leg 126 which can be selectively joined to the first bracket element 116 through the bolts 46 and nuts 48.

In this embodiment, the leg 120 on the first bracket element 116 has first and second openings 128, 130 which are selectively registrable with openings 132, 134 through the long leg 124 and openings 136, 138 through the short leg 126. The openings 128, 130 can be aligned with both of the openings 132, 134; 136, 138; or so that only one opening 130 aligns with a single opening 132, 136 on the long leg 124 or short leg 126, respectively.

In FIG. 10, one bracket variation is shown. Whereas in FIGS. 1–3, the first bracket element 28 is shown underlying the second bracket element 30, in FIG. 10 this relationship is reversed so that the first bracket element 28 overlies the second bracket element, 30. In either event, the joined relationship is maintained by the bolt 46 and the 48.

In FIG. 11, a further variation, according to the present invention, is shown. FIG. 11 represents a kit that can be provided in conjunction with a frame that allows variations for the distance d in FIG. 1. In FIG. 11, the second bracket element 30 is shown with the long leg 32 having a length L1 and the short leg 34 having a height H1. The bracket element 30 can be sold in conjunction with an interchangeable bracket element 140 having a corresponding long leg 142 and short leg 144 with a length L2 and height H2, corresponding to the length L1 and height H1. The length L2 is shorter than the length L1. The height H2 may be the same as or different than the height H1. A third bracket element 150 with transverse legs 152, 154 can also be provided for interchangeable connection to a frame. The leg 152 has a length L3, with the leg 154 having a height H3. The length L3 may be less than the length L2, with the height H3 being the same as, or less than, the height H2.

Accordingly, the kit, consisting of a frame 12, 72, 82, 92, 112 and the brackets 30, 140, 150, can be sold together. The end user can then select the brackets 30,140, 150 depending on the desired distance d. The kit can include two or all three of the brackets 30,140,150. In either event, the end user is given a substantial amount of flexibility in terms of selecting the distance d.

In FIG. 12, a first bracket element 156, corresponding to the first bracket element 28, is shown with fixed, integral, threaded studs 158,160 corresponding in location to the openings 40, 42. This obviates the need to use separate fasteners 46,48 and otherwise allows the first bracket element 156 to cooperate with the second bracket element 30 in the same manner as previously described.

As an alternative, as shown in FIG. 13, threaded studs 160, 162 may be formed on a bracket element 164, corresponding to the bracket element 30. This again obviates the need for separate fasteners 46, 48.

Figure 14:
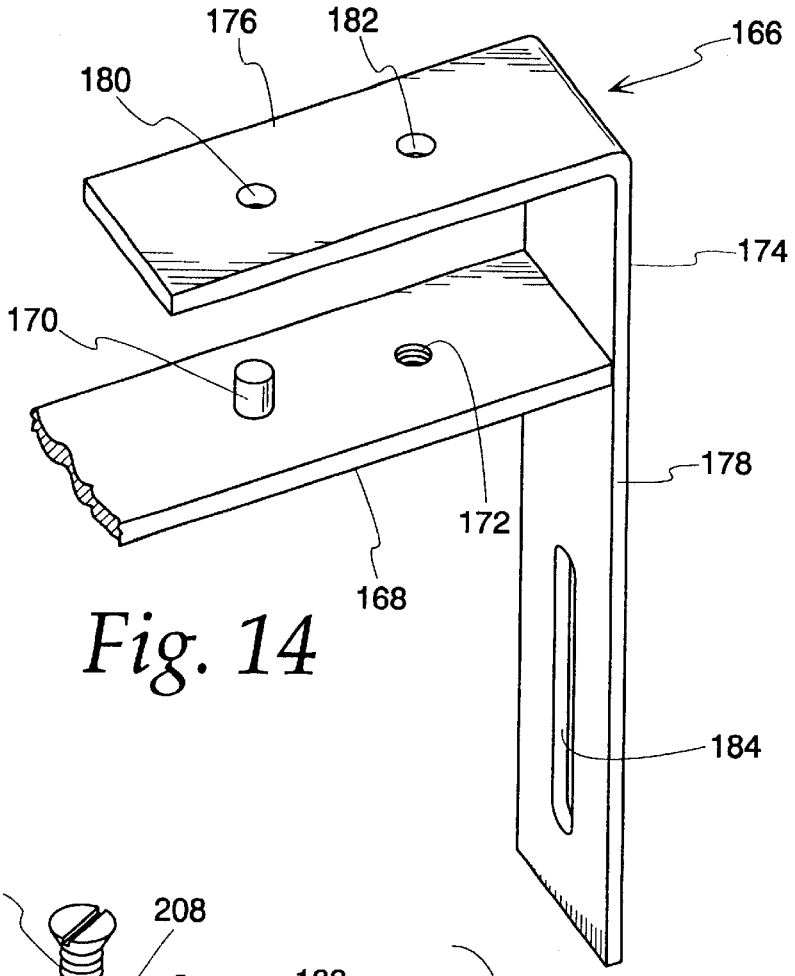
FIG. 14 is an exploded, fragmentary perspective view of a further modified form of bracket assembly, according to the present invention, utilizing a locator stud.

In FIG. 14, a further modified form of bracket assembly is shown at 166 including a first bracket element 168, which has a locating stud 170 and an opening 172. The bracket element 168 cooperates with a bracket element 174 having a short leg 176 and a long leg 178. The short leg 176 has openings 180, 182 which are registrable with the stud 170 and opening [182] 172. The stud 170 can be advanced into the opening 180. Thereafter, the bolt 46 can be directed through the aligned openings 182, 172.

The bracket 174 can be resituated to register the stud 170 and opening 172 with an opening 184 in the long leg 178, which opening 184 has the form of an elongate slot. The stud 170 is guidable lengthwise within the slot 184.

Figure 15:
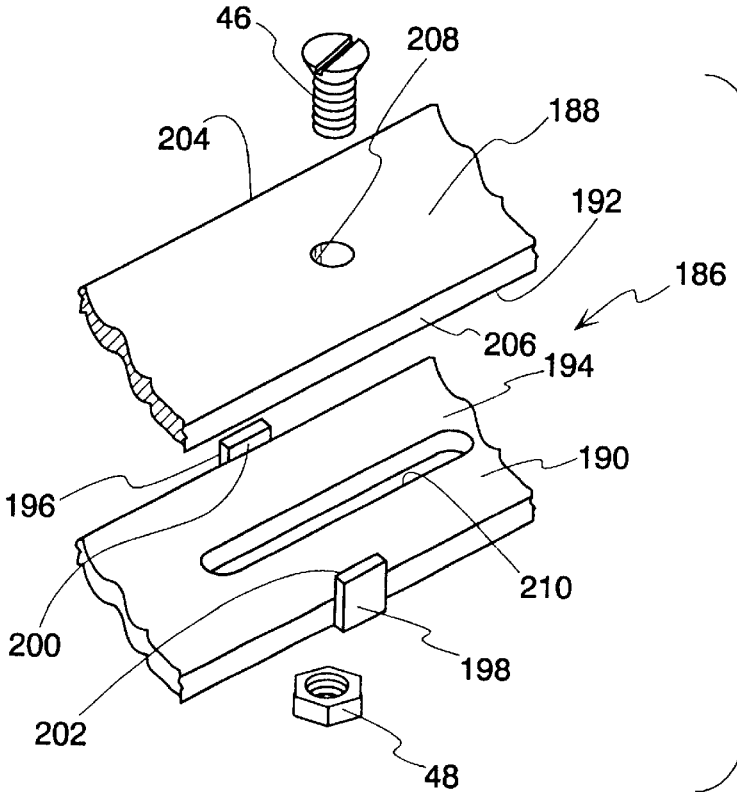
FIG. 15 is an exploded, fragmentary, perspective view of a modified form of bracket assembly, according to the present invention, including tabs which guide movement of one bracket element relative to the other.

In FIG. 15, a bracket assembly is shown at 186 including a first bracket element 188 and a second bracket element 190. The first bracket element 188 has a flat surface 192 which is facially abuttable to a flat surface 194 on the bracket element 190. Tabs 196,198 on the second bracket element 190 define facing surfaces 200, 202 which abut to the oppositely facing edges 204, 206 on the bracket element 188. The surface 200, 202 and edges 204, 206 cooperate to guide relative lengthwise movement between the bracket elements 188, 190. The bracket element 188 has an opening 208 that is registrable with an opening 210, in the form of an elongate slot, through the bracket element 190. The openings 208, 210 are registrable to receive the bolt 46 which cooperates with the nut 48.

Figure 16:
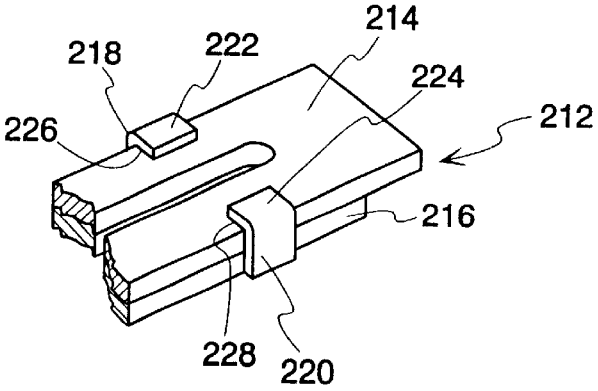
FIG. 16 is a view as in FIG. 15 of a further modified form of bracket assembly wherein tabs are used to captively maintain bracket elements, one against the other, for relative sliding movement.

In FIG. 16, a bracket assembly is shown at 212, consisting of a first bracket element 214 and a second bracket element 216. The second bracket element 216 has tabs 218, 220, corresponding to the tabs 196,198 on the bracket element 190 in FIG. 15. The tabs 218, 220 have inturned ends 222, 224 defining surfaces 226, 228, which, in conjunction with the bracket element 216, captively maintain the bracket element 214. The bracket elements 214, 216 are slidable lengthwise, one against the other, in this captive arrangement.

The foregoing disclosure of specific embodiments is intended to be illustrative of the broad concepts comprehended by the invention.

What is claimed is:

1. An article hanger comprising:

a frame comprising a plurality of wire elements defining an upwardly opening receptacle for an article, the frame comprising a peripheral wall extending fully around the upwardly opening receptacle and a bottom wall; and a bracket assembly on the frame through which the article hanger is maintainable in a hanging position on an upwardly facing surface on a support, said bracket assembly comprising:

a first bracket element on the frame;

a second bracket element that is joinable to the first bracket element so that at least one of the first and second bracket elements defines a downwardly facing surface that is abuttable to an upwardly facing surface on a support with the article hanger in the hanging position, the second bracket element having a depending portion which defines an edge which faces the receptacle and is spaced from the receptacle a distance;

an opening in at least one of the first and second bracket elements; and a fastener which is extendable through the opening in at least one of the first and second bracket elements to maintain the first and second bracket elements in joined relationship, the first and second bracket elements configured to allow the distance between the edge on the depending portion and the receptacle to be varied, wherein the opening in at least one of the first and second bracket elements comprises a third opening in one of the first and second bracket elements that is registrable with the opening in at least one of the first and second bracket elements to allow the fastener to be extended through the third opening and the opening in at least one of the first and second bracket elements.

2. The article hanger according to claim 1 wherein the first bracket element is fixedly attached to the frame.

3. The article hanger according to claim 2 wherein the first bracket element projects in cantilever fashion from the frame.

4. The article hanger according to claim 1 wherein the opening in at least one of the first and second bracket elements comprises a first opening in the first bracket element and a second opening in the second bracket element, the first and second openings registrable to allow the fastener to extend through each of the first and second openings with the first and second bracket elements in joined relationship.

5. The article hanger according to claim 4 wherein the first and second openings are registrable with the edge on the depending portion spaced from the receptacle first and second different distances.

6. The article hanger according to claim 5 wherein at least one of the first and second openings comprises an elongate slot.

7. The article hanger according to claim 1 wherein the second bracket element has an L shape with first and second transverse legs each having a length, the length of the first and second legs are different, and the first and second legs are selectively joinable to the first bracket element so that a) with the first leg joined to the first bracket element the second leg defines the edge which faces the receptacle and is spaced from the receptacle a first distance and b) with the second leg joined to the first bracket element the first leg defines the edge which faces the receptacle and is spaced from the receptacle a second distance that is different than the first distance.

8. The article hanger according to claim 1 wherein the fastener is separate from the first and second bracket elements.

9. The article hanger according to claim 7 wherein the fastener is fixedly attached to one of the first and second bracket elements.

10. The article hanger according to claim 1 wherein one of the first and second bracket elements has first and/second substantially flat transverse surfaces thereon separate from the fasteners that bear against the other of the first and second bracket elements to allow guided movement of the first and second bracket elements each against the other.

11. The article hanger according to claim 1 wherein one of the first and second bracket elements has a first surface and second and third, substantially flat facing surfaces and the other of the first and second bracket elements is guidable simultaneously against the first, second, and third surface between a) a first relative position wherein the edge on the depending portion of the second bracket element is spaced from the receptacle a first distance and b) a second relative position wherein the edge on the depending portion of the second bracket element id spaced from the receptacle a second distance.

12. The article hanger according to claim 11 wherein there is a fourth substantially flat surface on the one of the first and second bracket elements that faces the first surface and, in conjunction with the first surface, captively maintains the other of the first and second bracket elements.

13. In combination:

an article hanger comprising:

a frame defining a receptacle for an article; and a bracket assembly on the frame through which the article hanger is maintainable in a hanging position on an upwardly facing surface on a support, said bracket assembly comprising:

a first bracket element on the frame;

a second bracket element that is joinable to the first bracket element so that at least one of the first and second bracket elements defines a downwardly facing surface that is abuttable to an upwardly facing surface on a support with the article hanger in the hanging position, the second bracket element having a depending portion which defines an edge which faces the receptacle and is spaced from the receptacle a first distance;

an opening in at last one of the first and second bracket elements;

a third bracket element that is joinable to the first bracket element in place of the second bracket element so that at least one of the first and third bracket elements defines a downwardly facing surface that is abuttable to an upwardly facing surface on a support with the article hanger in the hanging position, the third bracket element having a depending portion which defines an edge which faces the receptacle and is spaced from the receptacle a second distance;

an opening in at least one of the first and third bracket elements; and a fastener which is extendable through a) the opening in at least one of the first and second bracket elements or b) the opening in at least one of the first and third bracket elements to maintain either the first and second bracket elements or the first and third bracket elements in joined relationship.

14. The article hanger according to claim 13 wherein the first distance is different than the second distance.

15. The article hanger according to claim 13 wherein the first bracket element is L-shaped with first and second transverse legs.

16. The article hanger according to claim 15 wherein the opening in at least one of the first and second bracket elements comprises a first opening in the first bracket element, a second opening in the first leg of the first bracket element, and a third opening in the second leg of the first bracket element.

17. The article hanger according to claim 16 wherein at least one of the first, second, and third openings comprises an elongate slot.

18. The article hanger according to claim 13 wherein the first bracket element is fixedly attached to the frame.

19. The article hanger according to claim 13 wherein the first bracket element projects in cantilever fashion from the frame.

* * * * *